US011655948B2

(12) United States Patent
Parker et al.

(10) Patent No.: US 11,655,948 B2
(45) Date of Patent: May 23, 2023

(54) LINEAR MODULAR LUMINAIRE

(71) Applicant: SIGNIFY HOLDING B.V., Eindhoven (NL)

(72) Inventors: Gregory Parker, Denver, CO (US); Alexander Ross, Aurora, CO (US); Ashley Pickens, Evergreen, CO (US); Kevin Strickfaden, Denver, CO (US); William Getzinger, Golden, CO (US); Stephen Geyer, Eindhoven (NL); Timothy Bingaman, Thornton, CO (US)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/795,246

(22) PCT Filed: Jan. 19, 2021

(86) PCT No.: PCT/EP2021/051069

§ 371 (c)(1),
(2) Date: Jul. 26, 2022

(87) PCT Pub. No.: WO2021/151728

PCT Pub. Date: Aug. 5, 2021

(65) Prior Publication Data

US 2023/0053387 A1 Feb. 23, 2023

Related U.S. Application Data

(60) Provisional application No. 62/966,435, filed on Jan. 27, 2020.

(30) Foreign Application Priority Data

May 7, 2020 (EP) ..... 20173574

(51) Int. Cl.
*F21S 4/28* (2016.01)
*F21V 29/70* (2015.01)
(Continued)

(52) U.S. Cl.
CPC ..... *F21S 4/28* (2016.01); *F21V 29/70* (2015.01); *F21Y 2103/10* (2016.08); *F21Y 2115/10* (2016.08)

(58) Field of Classification Search
CPC ..... F21S 4/28; F21V 29/70; F21Y 2103/10; F21Y 2115/10
See application file for complete search history.

(56) References Cited

U.S. PATENT DOCUMENTS

2011/0090686 A1* 4/2011 Pickard ..... F21V 1/00 362/235
2015/0316238 A1 11/2015 Guilmette
(Continued)

FOREIGN PATENT DOCUMENTS

CN 102121689 A * 7/2011
EP 3504475 B1 * 6/2021 ..... F21S 4/28
(Continued)

*Primary Examiner* — Jong-Suk (James) Lee
*Assistant Examiner* — Glenn Zimmerman

(57) ABSTRACT

A luminaire comprising: a chassis (100), the chassis (100) comprising: four walls joined to form a rectangular cavity, each wall of the four walls comprising: —a heat sink (107); —a wiring channel (111, 112); —a first receiving channel (114) on a first side of the heat sink (107); and—a second receiving channel (116) on a second side of the heat sink (107); a light emitting diode board (130) attached to a first wall of the four walls; a first extrusion (344) attached to a second wall of the four walls; a second extrusion (345) attached to a third wall of the four walls; wherein the light emitting diode board (130) comprises a first protrusion that fits into the first receiving channel and a second protrusion that fits into the second receiving channel; and wherein the
(Continued)

light emitting diode board (130) rests on the heat sink (107) of the first wall when the first protrusion is fit into the first receiving channel and the second protrusion is fit into the second receiving channel.

11 Claims, 4 Drawing Sheets

(51) Int. Cl.
*F21Y 103/10* (2016.01)
*F21Y 115/10* (2016.01)

(56) References Cited

U.S. PATENT DOCUMENTS

| | | | | |
|---|---|---|---|---|
| 2017/0370537 | A1 | 12/2017 | Wu et al. | |
| 2019/0203922 | A1* | 7/2019 | Bendtsen | G01J 1/4228 |
| 2020/0096189 | A1* | 3/2020 | Kim | F21V 29/713 |

FOREIGN PATENT DOCUMENTS

| | | | | |
|---|---|---|---|---|
| WO | 2018224393 | A1 | 12/2018 | |
| WO | WO-2020059930 | A1 * | 3/2020 | F21V 17/12 |

* cited by examiner

LINEAR MODULAR LUMINAIRE

CROSS-REFERENCE TO PRIOR APPLICATIONS

This application is the U.S. National Phase application under 35 U.S.C. § 371 of International Application No. PCT/EP2021/051069, filed on Jan. 19, 2021, which claims the benefit of U.S. Provisional Patent Application No. 62/966,435, filed on Jan. 27, 2020 and European Patent Application No. 20173574.3, filed on May 7, 2020. These applications are hereby incorporated by reference herein.

TECHNICAL FIELD

Embodiments of the technology relate generally to luminaires and more particularly to a luminaire with modular components.

BACKGROUND

A luminaire is a system for producing, controlling, and/or distributing light for illumination. Luminaires are often referred to as light fixtures. The lighting industry has been transitioning to using light emitting diodes as the light source in luminaires. As compared to incandescent and fluorescent light sources, light emitting diodes (LEDs) offer substantial potential benefit associated with their energy efficiency, light quality, and compact size. However, the process of designing a new luminaire can be inefficient. Many luminaires have common or similar components, but the work in designing of a new luminaire often involves duplication of work with respect to these common or similar components. Accordingly, a more efficient approach to designing new luminaires would be beneficial.

WO 2018/224393 relates to a solid state lighting lamp, The solid state lighting lamp comprising a plurality of heatsink modules each extending in alignment with a central axis of the lamp, each heatsink module carrying a plurality of solid state lighting elements; and a body extending in alignment with said central axis and delimiting an inner volume of the lamp, wherein the heatsink modules are affixed to said body. The body is the optical housing, i.e. the light exit window of the lamp.

BRIEF DESCRIPTION OF THE FIGURES

Reference will now be made to the accompanying drawings, which are not necessarily drawn to scale, and wherein.

Figure 1:
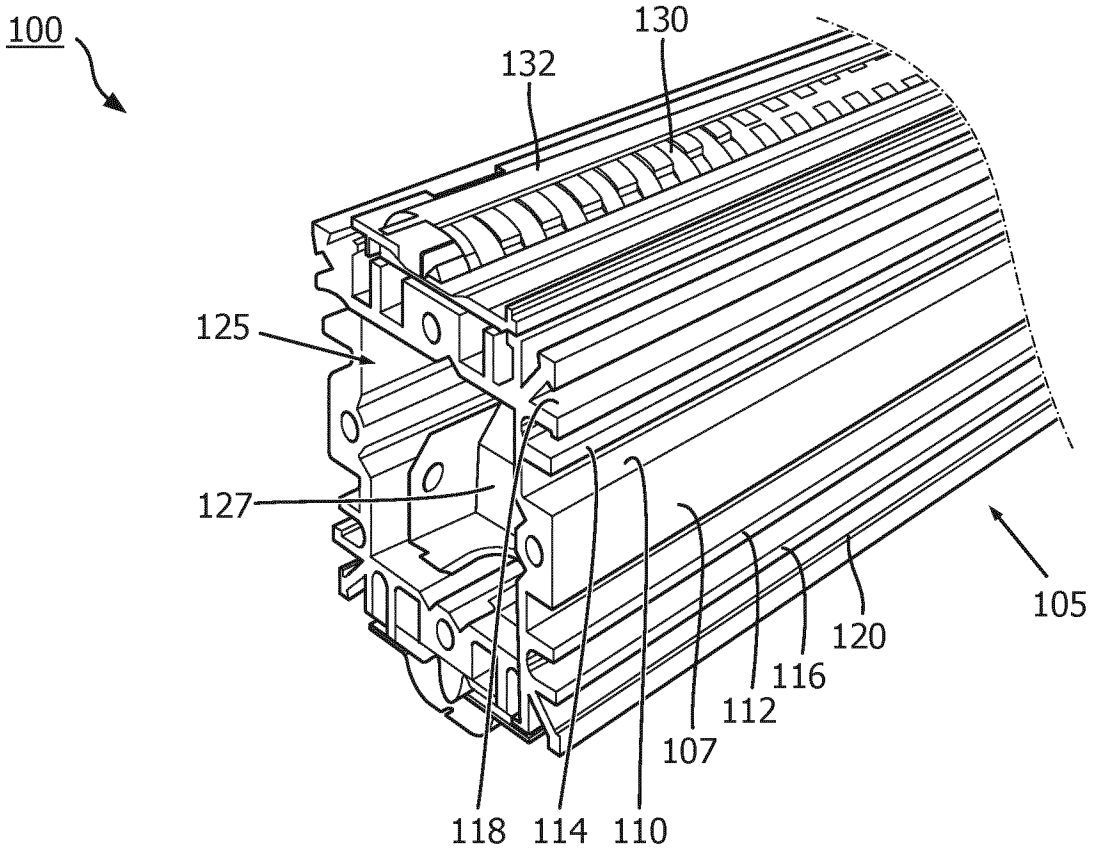
FIG. 1 illustrates a top perspective view of a portion of a luminaire according to an example embodiment of the present disclosure.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, the same reference numerals used in different drawings designate like or corresponding but not necessarily identical elements.

DETAILED DESCRIPTION OF EXAMPLE EMBODIMENTS

In the following paragraphs, example embodiments will be described in further detail with reference to the figures. In the description, well-known components, methods, and/or processing techniques are omitted or briefly described. Furthermore, reference to various feature(s) of the embodiments is not to suggest that all embodiments must include the referenced feature(s).

The example embodiments described herein relate to luminaires that can be mounted to or suspended from a mounting structure (e.g., a ceiling, a wall, a pole) or that can be recessed in a ceiling, wall, or other structure. The example luminaires described herein comprise a chassis that accommodates easy attachment of a variety of components commonly used in the design of a new luminaire. The chassis is beneficial in that it can eliminate repeating the design of certain components commonly found in luminaires. Additionally, because the chassis and certain of the attachable components can be re-used for a variety of different luminaires, they can eliminate the need to repeat certain testing for certification or compliance with various standards and regulations. It should be appreciated that the embodiments herein can also apply to other types of luminaires having other shapes or configurations.

Referring now to FIG. 1, a portion of a luminaire 100 is illustrated in accordance with an example embodiment of the present disclosure. The portion of the luminaire 100 shown in FIG. 1 comprises a chassis 105 that comprises four walls joined to form a cavity 125. Within the cavity 125 a power supply 127 is shown. It should be understood that the cavity 125 can also contain one or more backup batteries, controllers, or other components of the luminaire. One unique aspect of luminaire 100 is that the chassis accommodates attachment of a variety of other components to the chassis. As shown in FIG. 1, the outer surface of each wall of the chassis contains features used to make the design of a new luminaire more efficient. For example, running along the outer surface in the center of each wall of the chassis 125 is a heat sink 107. The heat sink 107 can be used to attach a circuit board 130 containing light emitting diodes and for absorbing heat from the circuit board 130. Disposed on each side of the heat sink 107 are wiring channels 110 and 112 for routing wiring from the circuit board 130 to the power supply 127. Adjacent to wiring channels 110 and 112 are first and second receiving channels 114 and 116. The first and second receiving channels 114 and 116 can receive protrusions on the bottom of an optic 132 thereby securing the optic 132 to the chassis. Adjacent to the first and second receiving channels 114 and 116 are third and fourth receiving channels 118 and 120. The third and fourth receiving channels 118 and 120 can receive an outer component such as an outer optic or an extrusion that covers the side of the luminaire 100.

The walls of the chassis 100 can be separable in order to provide access to the cavity 125 for making wiring connections and attaching components. While the four chassis walls of the example shown in FIG. 1 are substantially identical, in alternate embodiments, different walls of the chassis can have different numbers of heat sinks, wiring channels, and receiving channels to accommodate attachment of different components. Furthermore, while example chassis 105 is shown having an elongated rectangular shape, it should be understood that in other embodiments the chassis can have other shapes. For example, the chassis could comprise three walls forming a triangular cross-sectional shape or 5 walls forming a pentagonal cross-sectional shape. In yet another example, the walls of the chassis could be rounded forming a circular or oval cross-sectional shape. The chassis can also vary in length.

Figure 2:
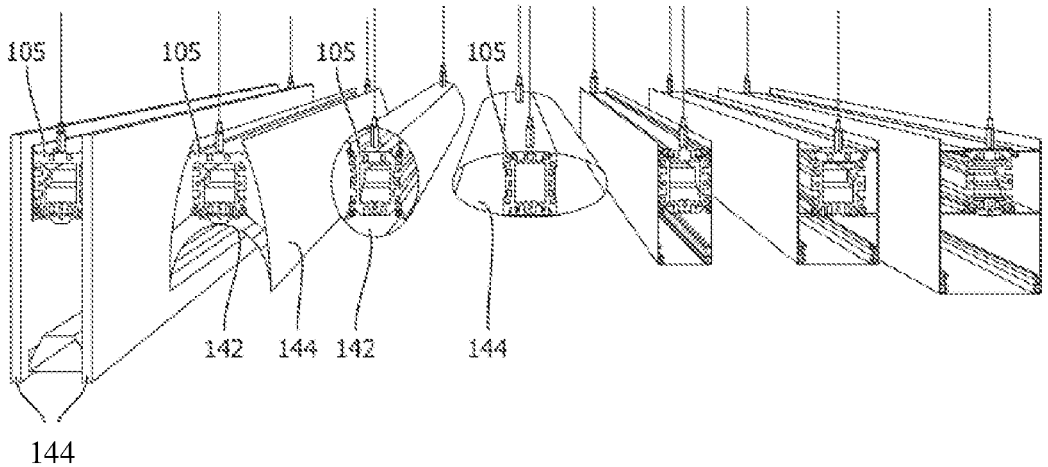
FIG. 2 illustrates several examples of luminaires according to example embodiments of the present disclosure.

Referring now to FIG. 2, several example luminaires are illustrated in accordance with the example embodiments of the present disclosure. The example luminaires shown in FIG. 2 each comprise a chassis 105, however, the examples also show the variety of different types of components that can be attached to the walls of the chassis 105. As one example, various types of extrusions 144 can be attached to the side walls of the chassis 105 as shown in the examples of FIG. 2. Each of the extrusions comprise a pair of protrusions on the inner surface of the extrusion so that the protrusions can fit into the third and fourth receiving channels in each side wall of the chassis 105. As another example, the luminaires shown in FIG. 2 can comprise an outer optic 142 that attaches to the extrusions 144 or that can fit into receiving channels of the chassis 105. It should be understood that the flexibility of the chassis allows for attachment of a circuit board with LEDs and an optic to any side of the chassis 105 so that light can be directed upward, downward, or to one or both sides. As another example, extrusions with acoustic panels 140 can be attached to chassis 105. The acoustic panels can be made from one or more of a variety of materials known to be effective for absorbing sound such as foam, cork, felt, various polymers such as polyethylene terephthalate ("PET"), other porous materials, and combinations of the foregoing materials.

Figure 3:
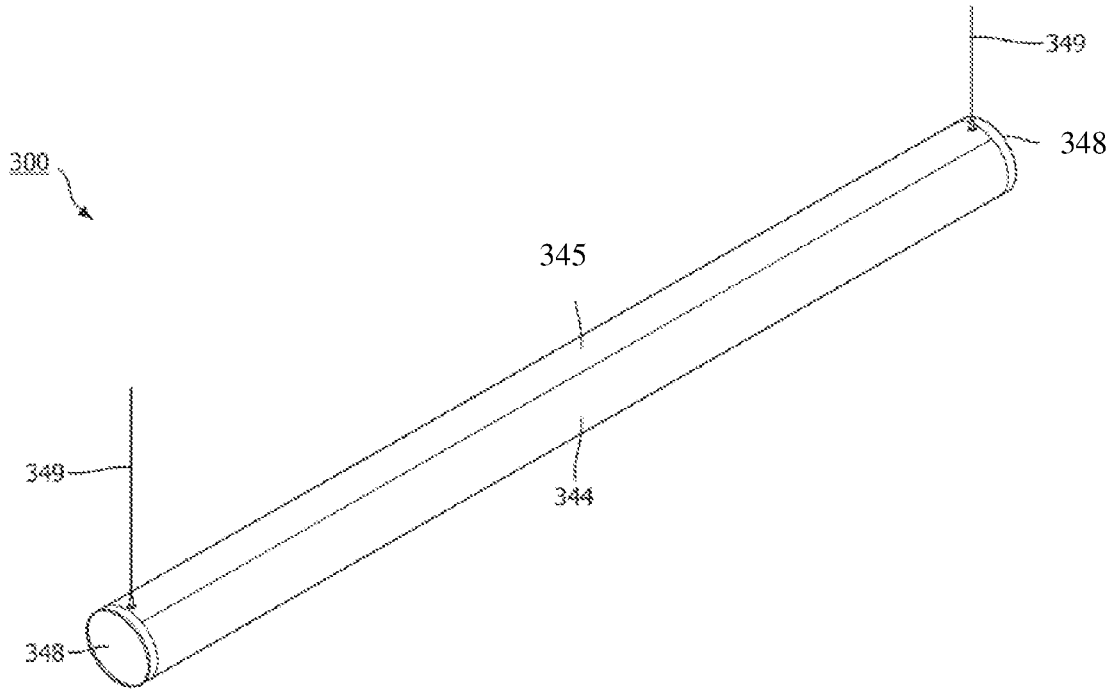
FIG. 3 illustrates a top perspective view of another luminaire according to an example embodiment of the present disclosure.
Figure 4:
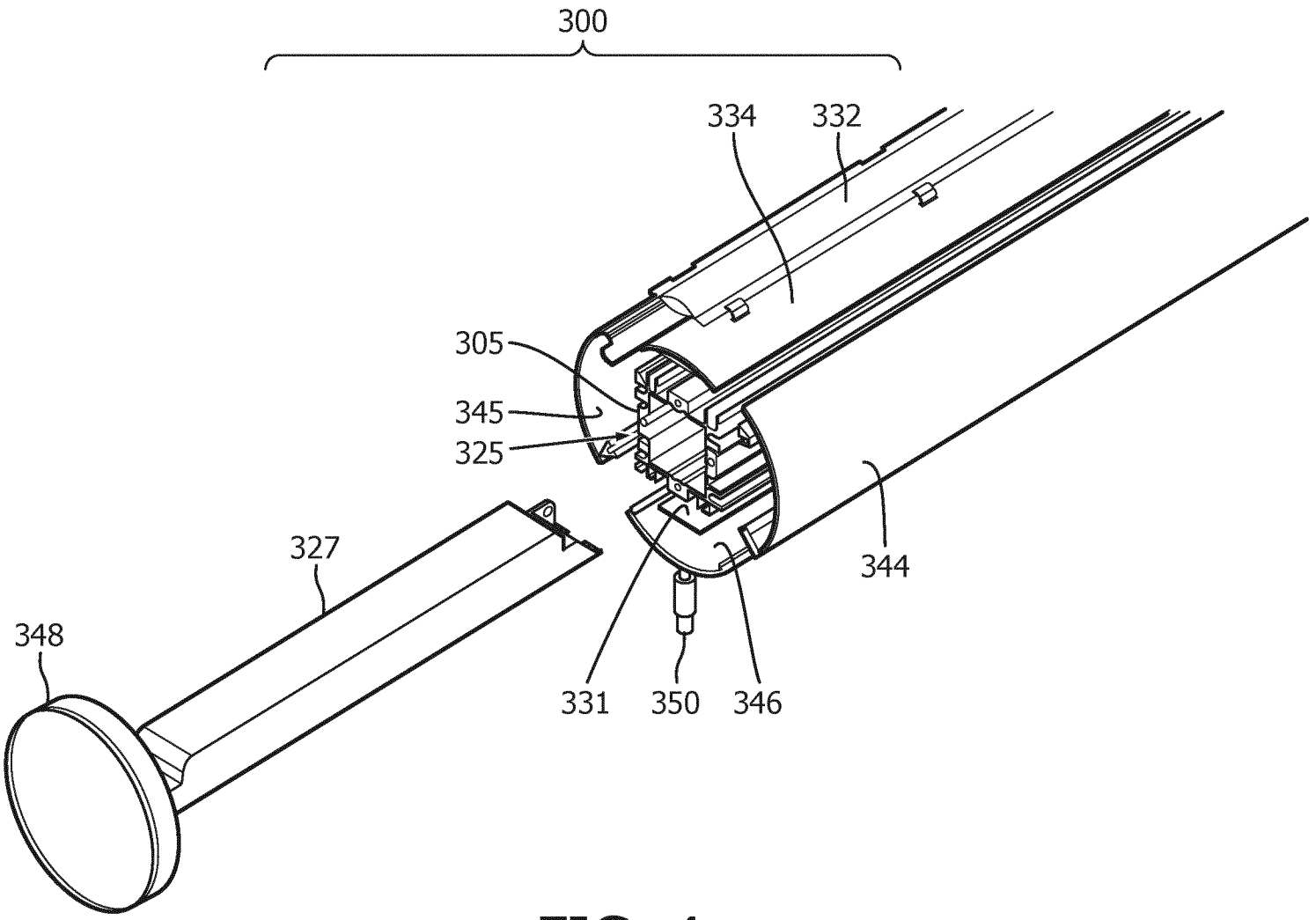
FIG. 4 illustrates an enlarged exploded view of the luminaire of FIG. 3 according to an example embodiment of the present disclosure.

Referring now to FIGS. 3 and 4, another example luminaire 300 is shown. Example luminaire 300 includes suspension cables 349 that can be secured to the luminaire with securing mechanisms 350 for hanging the luminaire from a ceiling or other structure. The outer portion of luminaire 300 includes end caps 348 attached to ends of chassis 305. Along the length of luminaire 300, extrusions 344 and 345 are attached to each side of the chassis 305 by inserting protrusions on the inner surface of each extrusion into receiving channels in the chassis 305. Example luminaire 300 further comprises an LED circuit board mounted on the top surface (not visible in FIG. 4) of the chassis 305 and an LED circuit board 331 mounted on the bottom surface of the chassis 305. The chassis 305 provides the flexibility to secure one or more optics over the top and bottom LED circuit boards. For example, FIG. 4 shows a top inner optic 332 that can attached to first and second receiving channels on the top surface of the chassis 305. FIG. 4 also shows a bottom outer optic 346 that can attach to receiving channels on the bottom surface of the chassis 305.

The exploded view of FIG. 4 also shows the power supply 327 that is typically disposed within the cavity 325 of the chassis 305. The power supply can receive power from an external power source, such as the electrical grid, via a power cable (not shown). The power cable can attach to the luminaire 300 via an aperture in the end cap or one of the outer extrusions. In an alternate embodiment, a power supply track can extend in the cavity 325 along the inner surface of the chassis 305. Such a power supply track can receive power from an external power cable and can allow various components within the cavity 325 to be attached to the power supply track for receiving power.

In the example luminaires illustrated herein, the light sources comprise LEDs mounted to a circuit board. However, in alternate embodiments, the light source can be in the form of one or more organic LEDs, a fluorescent light source, a halogen light source, or some other type of light source. Certain light sources such as LED light sources and fluorescent light sources require regulated power and, in those cases, the light sources can receive regulated power from the previously described power supply located within the chassis. As non-limiting examples, the power supply can comprise one or more of a driver, a ballast, a switched mode power supply, an AC to DC converter, a transformer, or a rectifier that can provide regulated power to the light source. It should also be understood that in alternate embodiments, a power supply can be located remotely from the luminaire, such as in a plenum space above a ceiling from which the luminaire is suspended. The power supply can comprise class 1 connections for receiving power from a power source such as AC mains or grid power (e.g. 120 VAC, 230 VAC) from the electrical power grid or a renewable power source. The power supply can modify the power received from the power source and can comprise class 2 low voltage connections for coupling to the light source. The class 2 low voltage connections can supply low voltage power (e.g. 20 VDC to 60 VDC) via a low voltage cable to the light source of the luminaire. In certain embodiments, the low voltage power cable can also be the suspension cable that suspends the luminaire from a ceiling or other structure. In other embodiments, the low voltage power cable can be attached to and run alongside the suspension cable that suspends the luminaire from a ceiling or other structure.

In certain example embodiments, the example luminaires described herein are subject to meeting certain standards and/or requirements. For example, the National Electric Code (NEC), the National Electrical Manufacturers Association (NEMA), the International Electrotechnical Commission (IEC), the Federal Communication Commission (FCC), and the Institute of Electrical and Electronics Engineers (IEEE) set standards as to electrical enclosures (e.g., light fixtures), wiring, and electrical connections. As another example, Underwriters Laboratories (UL) sets various standards for light fixtures. Use of example embodiments described herein meet (and/or allow a corresponding device to meet) such standards when required.

Referring generally to the foregoing examples, any luminaire components (e.g., the chassis, the extrusions), described herein can be made from a single piece (e.g., as from a mold, injection mold, die cast, 3-D printing process, extrusion process, stamping process, or other prototype methods). In addition, or in the alternative, a luminaire (or components thereof) can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, and slotted fittings. One or more pieces that are mechanically coupled to each other can be coupled to each other in one or more of a number of ways, including but not limited to fixedly, hingedly, removably, slidably, and threadably.

A fastener or attachment feature (including a complementary attachment feature) as described herein can allow one or more components and/or portions of an example luminaire to become coupled, directly or indirectly, to another portion or other component of a luminaire. An attachment feature can include, but is not limited to, a flange, a snap, Velcro, a clamp, a portion of a hinge, an aperture, a recessed area, a protrusion, a slot, a spring clip, a tab, a detent, and mating threads. A component can be coupled to a luminaire by the direct use of one or more attachment features.

In addition, or in the alternative, a portion of a luminaire can be coupled using one or more independent devices that interact with one or more attachment features disposed on the light fixture or a component of the light fixture. Examples of such devices can include, but are not limited to, a pin, a hinge, a fastening device (e.g., a bolt, a screw, a rivet), epoxy, glue, adhesive, tape, and a spring. One attachment feature described herein can be the same as, or different than, one or more other attachment features described herein. A complementary attachment feature (also sometimes called a corresponding attachment feature) as described herein can be a coupling feature that mechanically couples, directly or indirectly, with another coupling feature.

Terms such as "first", "second", "top", "bottom", "side", "distal", "proximal", and "within" are used merely to distinguish one component (or part of a component or state of a component) from another. Such terms are not meant to denote a preference or a particular orientation, and are not meant to limit the embodiments described herein. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Although particular embodiments have been described herein in detail, the descriptions are by way of example. The features of the example embodiments described herein are representative and, in alternative embodiments, certain features, elements, and/or steps may be added or omitted. Additionally, modifications to aspects of the example embodiments described herein may be made by those skilled in the art without departing from the scope of the following claims, the scope of which are to be accorded the broadest interpretation so as to encompass modifications and equivalent structures.

The invention claimed is:

1. A luminaire comprising:

a chassis, the chassis comprising:

four walls joined to form a rectangular cavity, each wall of the four walls comprising:

a heat sink;

a wiring channel;

a first receiving channel on a first side of the heat sink; and a second receiving channel on a second side of the heat sink;

a light emitting diode board attached to a first wall of the four walls;

a first extrusion attached to a second wall of the four walls;

a second extrusion attached to a third wall of the four walls; wherein the light emitting diode board comprises a first protrusion that fits into the first receiving channel and a second protrusion that fits into the second receiving channel; and wherein the light emitting diode board rests on the heat sink of the first wall when the first protrusion is fit into the first receiving channel and the second protrusion is fit into the second receiving channel.

2. The luminaire of claim 1, wherein the chassis is separable into at least two components to provide access to the rectangular cavity.

3. The luminaire of claim 1, wherein the rectangular cavity comprises one or more of a power supply, a battery, and a controller.

4. The luminaire of claim 3, further comprising wiring extending from the light emitting diode board, through the wiring channel, and to the power supply.

5. The luminaire of claim 1, wherein each wall of the four walls further comprise:

a third receiving channel adjacent to the first receiving channel; and a fourth receiving channel adjacent to the second receiving channel.

6. The luminaire of claim 5, wherein the first extrusion is attached to the third receiving channel and the fourth receiving channel of the second wall.

7. The luminaire of claim 5, wherein the second extrusion is attached to the third receiving channel and the fourth receiving channel of the third wall.

8. The luminaire of claim 1, further comprising:

a first end cap that attaches to a first end of the chassis; and a second end cap that attaches to a second end of the chassis.

9. The luminaire of claim 1, wherein each wall of the four walls further comprises at least one aperture for securing a suspension cable.

10. The luminaire of claim 1, further comprising an aperture for receiving a power cable.

11. The luminaire of claim 10, wherein the power cable electrically couples to a bus bar disposed within the rectangular cavity.

* * * * *